United States Patent [19]

Eda et al.

[11] 4,169,071

[45] Sep. 25, 1979

[54] VOLTAGE-DEPENDENT RESISTOR AND METHOD OF MAKING THE SAME

[75] Inventors: Kazuo Eda, Hirakata; Makino Osamu, Osaka; Inada Masanori, Nara; Iga Atsushi, Takatsuki; Sakai Masayuki, Katano; Matsuoka Michio, Ibaragi, all of Japan

[73] Assignee: Matsushita Electric Industrial Co., Ltd., Japan

[21] Appl. No.: 852,048

[22] Filed: Nov. 16, 1977

[30] Foreign Application Priority Data

Nov. 19, 1976 [JP] Japan ..... 51/139995

[51] Int. Cl.[2] ..... H01B 1/08

[52] U.S. Cl. ..... 252/517; 252/518; 252/519; 252/520; 252/521

[58] Field of Search ..... 252/517-521; 264/104

[56] References Cited

U.S. PATENT DOCUMENTS

| | | | |
|---|---|---|---|
| 3,962,144 | 6/1976 | Matsurra et al. | 252/521 X |
| 4,003,855 | 1/1977 | Wong | 252/521 X |
| 4,028,277 | 7/1977 | Matsuura et al. | 252/521 X |

*Primary Examiner*—Benjamin R. Padgett
*Assistant Examiner*—E. Suzanne Parr
*Attorney, Agent, or Firm*—Wenderoth, Lind & Ponack

[57] ABSTRACT

A voltage-dependent resistor comprising a sintered body comprising ZnO as a major part and additives wherein at least 10 weight percent of the ZnO is composed of ZnO grains having a grain size in the range from 100 to 500 microns; and method of making the same wherein the starting mixture comprises ZnO grains having a grain size in the range from 20 to 200 microns. This voltage-dependent resistor has both a low C-value and a high surge energy withstanding capability. It also has a low leakage current at a high temperature due to the addition of an antimony component as a spinel type polycrystalline $Zn_{7/3}Sb_{2/3}O_4$.

35 Claims, 1 Drawing Figure

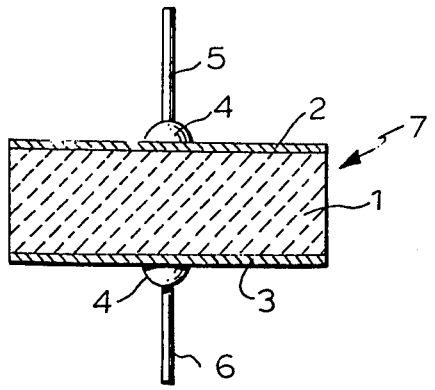
5
4
2
7
1
4
3
6

VOLTAGE-DEPENDENT RESISTOR AND METHOD OF MAKING THE SAME

This invention relates to a voltage-dependent resistor (varistor) having non-ohmic properties (voltage-dependent properties) due to the bulk thereof and method of making the same, more particularly to a voltage-dependent resistor, which is suitable for a surge absorber and a D.C. stabilizer used in low voltage circuits.

Various voltage-dependent resistors have been widely used for stabilization of voltage of electrical circuits or suppression of abnormally high surge induced an electrical circuits. The electrical characteristics of such voltage-dependent resistors are expressed by the relation:

$$I=(V/C)^n \quad (1)$$

where V is the voltage across the resistor, I is the current flowing through the resistor, C is a constant corresponding to the voltage at a given current and exponent n is a numerical value greater than 1. The value of n is calculated by the following equation:

$$n=[\log_{10}(I_2/I_1)]/[\log_{10}(V_2/V_1)] \quad (2)$$

where $V_1$ and $V_2$ are the voltages at given currents $I_1$ and $I_2$, respectively. The desired value of C depends upon the kind of application to which the resistor is to be put. It is ordinarily desirable that the value of n be as large as possible since this exponent determines the extent to which the resistors depart from ohmic characteristics. Conveniently, the n-value defined by $I_1$, $I_2$, $V_1$ and $V_2$ as shown in equation (2) is expressed by $_1n_2$ to distinguish it from the n-value calculated by other currents or voltages.

There have been known voltage-dependent resistors of the bulk type comprising an sintered body of zinc oxide with additives, as seen in U.S. Pat. Nos. 3,663,458, 3,632,529, 3,634,337, 3,598,763, 3,682,841, 3,642,664, 3,658,725, 3,687,871, 3,723,175, 3,778,743, 3,806,765, 3,811,103, 3,936,396, 3,863,193, 3,872,582 and 3,953,373. These zinc oxide voltage-dependent resistors of the bulk type contain, as additives, one or more combinations of oxides or fluorides of bismuth, cobalt, manganese, barium, boron, berylium, magnesium, calcium, strontium, titanium, antimony, germanium, chlorimum, nickel, niobium, tantalum, tungsten, uranium, iron, cadmium, aluminum, gallium, indium, silicon, tin, lead, lanthanum, praseodymium, neodymium and samarium. The C-value thereof may be controlled, primarily by changing the compositions of said sintered body and the distance between electrodes. They have an excellent voltage-dependent properties for the n-values in a region of current below 10 A/cm$^2$. For a current higher than 10 A/cm$^2$, however, the n-value falls to below 10.

This defect of these zinc oxide voltage-dependent resistors of bulk type is presumably due mainly to their low n-value for the lower C-value, especially less than 80 volts. In general, these zinc oxide voltage-dependent resistors of the bulk type, mentioned above, have very low n-value, i.e. less than 20, when the C-value is lower than 80 volts. The power dissipation for surge energy, however, has a relatively low value is compared with that of the conventional silicon carbide voltage-dependent resistor, so that the change rate of C-value exceeds e.g. 20 percent after two standard surges of $8\times20$ $\mu$sec wave form in a peak current of 500 A/cm$^2$, applied to the zinc oxide voltage-dependent resistors of the bulk type.

Another defect of these zinc oxide voltage-dependent resistors of the bulk type is a poor stability to D.C. load, particularly their remarkable decrease of C-value measured even in a current region such as 10 mA, after applying a high D.C. power to the voltage-dependent resistors especially when they have a C-value of less than 80 volts. This deterioration in the C-value, especially less than 80 volts, in unfavorable e.g. for a voltage stabilizer which requires high accuracy and low loss for low voltage circuits.

These defects of these zinc oxide voltage-dependent resistors of bulk type are presumbly due mainly to their low n-value for the lower C-values, especially of less than 80 volts. The development of the voltage-dependent resistors having a C-value e.g. less than 80 volts has been strongly desired for the application of the low voltage circuit, such as in the automobile industry and home appliances, but the n-value of conventional voltage-dependent resistors having lower C-values is too small to satisfy uses such as voltage stabilizers and surge absorbers. For these reasons, voltage-dependent resistors of this type, having a C-value less than 80 volts, have hardly been used in low voltage application.

In order to satisfy these desires, many improvements were tried and, at the present, such desires are satisfied by the improvements shown in U.S. Pat. Nos. 3,962,144 and 4,028,277 which include the new technology in compositions and fabrication process of resistor bodies. However, the desire for voltage-dependent resistors becomes stronger, especially in the application of low voltage circuits such as in automotive use. For this purpose, the voltage-dependent resistor must satisfy the new desire in the electrical properties. As the circuit voltage is D.C. 12 to 16 volts in automotive use and the protection level for semiconductor elements is fairly low, the C-value of voltage-dependent resistor should be smaller than that already satisfied by the previous techniques. A most important problem is to develop a new voltage-dependent resistor having low C-value below 40 volts, high n-value in the high current region i.e. above 10 A/cm$^2$ and additionally having a large surge energy withstanding capability of 50 to 150 joules and a high operating temperature up to 150° C., that is more specifically a low leakage current at a high temperature up to 150° C. The latter two requirements are not yet satisfied by the improvements in the previous patents.

In order to suppress the surge observed in a battery circuit of an automobile, the so called giant surge, a surge absorber is required to have a surge energy withstanding capability above 50 joules. The voltage-dependent resistor according to the previous patents has a surge energy withstanding capability of about 1 to 25 joules for the low C-values, which cannot satisfy the desired value mentioned above. The ambient temperature of voltage-dependent resistors set in the engine compartment of an automobile is supposed to be 150° C. at the maximum. The voltage-dependent resistors according to the previous patents have a maximum operating temperature of 70° C. and such temperature is too low to satisfy the new desire mentioned above. Conventionally, titanium oxide ($TiO_2$) or beryllium oxide (BeO) is used as an additive for obtaining a voltage-dependent resistor having a low C-value. However, by the sole technique of using such an additive, the surge energy withstanding capability of the resistor is poor.

An object of this invention is to provide a voltage-dependent resistor having a low C-value less than 40 volts, a high n-value even in a region of current above 10 A/cm$^2$ and a high surge energy withstanding capability of above 50 joules.

Another object of this invention is to provide a voltage-dependent resistor which has a high operating temperature up to 150° C. in addition to the above desired properties.

These and other objects of this invention will become apparent upon consideration of the following detailed description taken together with the accompanying drawing in which the single FIGURE is a cross-sectional view of a voltage dependent resistor in accordance with this invention.

Before proceeding with a detailed description of the manufacturing process of the voltage-dependent resistor contemplated by this invention, its construction will be described with reference to the single FIGURE wherein reference numeral 10 designates, as a whole, a voltage-dependent resistor comprising, as its active element, a sintered body having a pair of electrodes 2 and 3 in ohmic contact applied to opposite surfaces thereof. The sintered body 1 is prepared in a manner hereinafter set forth and is in any form such as circular, square or rectangular plate form. Wire leads 5 and 6 are attached conductively to the electrodes 2 and 3, respectively, by a connection means 4 such as solder or the like.

It has been discovered according to this invention that a low C-value and a high surge energy withstanding capability, without deterioration of a high n-value due to an additive component for giving the sintered body a voltage-dependent property, can be obtained by a voltage-dependent resistor comprising a sintered body of bulk type, which body comprises a zinc oxide component as a main component and 0.1 to 25 mole percent, in total, of an additive component for giving the sintered body a voltage-dependent property, characterized in that the zinc oxide componenet comprises 10 to 100 weight percent of zinc oxide grains having a grain size in the range from 100 to 500 microns and preferably from 100 to 300 microns (such zinc oxide grains being defined herein as zinc oxide core grains) uniformly dispersed in the sintered body. It has been also discovered according to this invention that such a voltage-dependent resistor can be made by a method comprising: homogeneously mixing zinc oxide grains having a grain size of 20 to 200 microns (such zinc oxide grains being defined herein as zinc oxide seed grains, SG) with a zinc oxide powder and an additive component for giving the sintered body a voltage-dependent property in an amount that the thus made mixture comprises 0.1 to 25 mole percent of the additive component, and that the zinc oxide component composed of the zinc oxide seed grains and the zinc oxide powder comprises 0.1 to 60 weight percent of the zinc oxide seed grains; compressing the thus made mixture into a compressed body; and sintering the thus made compressed body at a temperature of 1100°to 1400° C., whereby the zinc oxide seed grains grow to an increased grain size in the range from 50 to 500 microns by taking the zinc oxide powder thereinto.

The thus made grains having an increased grain size are what are defined above as zinc oxide core grains. The growth of the zinc oxide seed grains is caused by the phenomenon that the zinc oxide powder particles having a particle size usually in the range of 0.1 to 2 microns are adsorbed in neighboring zinc oxide seed grains to form zinc oxide grains having an increased grain size. The zinc oxide powder particles can have a larger particle size than 2 microns, but should be smaller than 20 microns. In order for the seed grains to grow, the zinc oxide seed grains should have a grain size larger than the particle size of the zinc oxide powder particle. As the difference between the grain size of the seed grains and the particle size of the zinc oxide becomes larger, the seed grains can grow more. Further, for the resultant sintered body to have a lower porosity or a higher density, the zinc oxide powder should preferably have a smaller particle size. For this reason, preferred particle size of the zinc oxide powder is between 0.1 and 2 microns, more preferably between 0.1 and 1 micron. The grain size of the seed grains is measured by using a sieve or mesh. The grain size of the core grains is measured by: cutting the resultant sintered body by a plane perpendicular to both the electrodes to be applied on opposite major surfaces of the sintered body; and drawing, on the cut surface of the sintered body, two tangential lines which are parallel to the opposite major surfaces of the sintered body and which respectively pass the points of each cut grain on the cut surface of the sintered body which points are nearest to the opposite major surfaces, respectively, of the sintered body. The grain size of each core grain is the distance between the thus drawn two tangential lines for the core grain.

It is known that a leakage current in a voltage-dependent resistor, which should be as small as possible, increases as the temperature of the resistor increases. The operating temperature range of a voltage-dependent resistor is the temperature range in which the leakage current is not too large to keep the resistor operable. The maximum operating temperature of a voltage-dependent resistor depends on the composition of sintered body. Generally, the sintered body containing antimony oxide ($Sb_2O_3$) has a smaller leakage current at a high temperature. However, conventionally, the addition of antimony oxide to the sintered body causes a disadvantage in that the C-value is greatly increased thereby. The sintered body of the resistor of this invention, however, can contain antimony oxide to have a high operating temperature without a great increase of the C-value. It is the discovery according to a further development of this invention that when the addition of the antimony component is carried out in the form of a compound of spinel type polycrystalline $Zn_{7/3}Sb_{2/3}O_4$, the leakage current at a high temperature can be more effectively suppressed without an undesired increase of the C-value and without undesirably deteriorating the surge energy withstanding capability.

The sintered body 1 can be prepared by per se well known ceramic techniques. The starting materials of ZnO, additives and ZnO seed grains with or without the spinel type polycrystalline $Zn_{7/3}Sb_{2/3}O_4$ are mixed in a wet mill so as to produce homogeneous mixtures. The mixtures are dried and pressed in a mold into desired shapes at a pressure from 50 kg/cm$^2$ to 500 kg/cm$^2$. The pressed bodies are sintered in air at 1100° C. to 1400° C. for 0.5 to 20 hours, and then furnace-cooled to room temperature (about 15° C. to about 30° C.). The mixture to be pressed can be admixed with a suitable binder such as water, polyvinyl alcohol, etc. It is advantageous that the sintered body be lapped at the opposite surfaces by abrasive powder such as silicon carbide in a particle size of about 10 to 50μ in mean diameter. The sintered bodies are provided, at the opposite surfaces thereof, with electrodes in any available and suitable method such as silver painting, vacuum evaporation or flame spraying of metal such as Al, Zn, Sn, etc.

The voltage-dependent properties are not partically affected by the kind of electrodes used, but are affected by the thickness of the sintered bodies. Particularly, the C-value varies in proportion to the thickness of the sintered bodies, while the n-value is almost independent of the thickness. This surely means that the voltage-dependent property is due to the bulk itself, not to the electrodes.

Lead wires can be attached to the electrodes in a per se conventional manner by using conventional solder. It is convenient to employ a conductive adhesive comprising silver powder and resin in an organic solvent in order to connect the lead wires to the electrodes. Voltage-dependent resistors according to this invention have a high stability or the surge test. The n-value does not change remarkably after the heating cycles, the load life test, humidity test and surge life test. It is advantageous for achievement of high stability with respect to humidity that the resultant voltage-dependent resistors be embedded in a humidity proof resin such as epoxy resin and phenol resin in a per se well known manner.

Conventionally, a fine zinc oxide powder in the particle size usually between 0.1 and 2 microns is mixed with proper additives for giving the resultant sintered body a voltage-dependent property, and the thus made mixture is compressed and sintered to make a voltage-dependent resistor. The feature of this invention is that when zinc oxide grains (as seed grains), each of which is composed of or comprises a zinc oxide single crystal or a zinc oxide polycrystal in the grain size between 20 to 200 microns, are substituted for a portion of the fine zinc oxide powder, the zinc oxide seed grains remarkably grow to have an increased grain size (as zinc oxide core grains) by absorbing the fine zinc oxide powder. In the case that the thus made sintered body comprises zinc oxide core grains having a grain size in the range between 100 and 500 microns in an amount between 10 and 100 weight percent on the basis of the zinc oxide component composed of the zinc oxide core grains and the fine zinc oxide powder, the sintered body can have a desirably low C-value and a desirably high surge energy withstanding capability. The zinc oxide seed grains are designated herein by SG, and the other component of the starting mixture composed of the fine zinc oxide powder and the additives (which may contain a spinel type polycrystalline powder, SP, mainly of $Zn_{7/3}Sb_{2/3}O_4$ as will be described later) is designated herein by base powder, BP.

According to this invention, the preferred amount and grain size of the zinc oxide seed grains are from 0.1 to 60 weight percent on the basis of the total zinc oxide component in the sintered body and from 20 to 200 microns, respectively. The preferred amount of the additives to be added to the sintered body and to give the sintered body a voltage-dependent property is from 0.1 to 25 mole percent on the basis of the sintered body. Thereby, a sintered body comprising zinc oxide core grains having a grain size of 100 to 500 microns in an amount of 10 to 100 weight percent on the basis of the total zinc oxide component can be obtained.

An example of the method of making a voltage-dependent resistor according to this invention will be described hereinbelow. In the first place, it is necessary to homogeneously mix a starting material containing zinc oxide seed grains. For this mixing step, a mixing method which does not pulverize the seed grains is necessarily used. For example, a wet ball mill method using resin balls (each having an iron core in it), which have a low pulverization power, can be used therefor. By compressing the thus made homogeneous mixture into a compressed body, and by sintering the compressed body, and applying electrodes to the opposite major surfaces of the thus made sintered body, a voltage-dependent resistor can be made. The grain growth rate of the zinc oxide seed grains is determined mainly by the sintering temperature and the sintering time. When a higher sintering temperature is used, the sintering time can be shorter, or vice versa. A preferable sintering temperature is from 1100°to 1400° C., and preferred sintering time is from 0.5 to 20 hours. When the sintering temperature is too low, the seed grains cannot grow to the desired core grains even if the sintering time is very long. On the other hand, if the sintering temperature is too high, the grain growth rate does not increase, and rather the additive component may undesirably evaporate and the sintering furnace may be damaged. If the sintering time is too short, the grain growth rate of the seed grains is too low, and the sintered body may not be sufficiently uniform. On the other hand, if the sintering time is too long, the grain growth rate of the seed grains does not increase with an increase in the sintering time because the grain growth becomes saturated after a sufficient sintering time.

The grain size of the zinc oxide seed grains is preferably between 20 and 200 microns. In a sintered body, the zinc oxide grains grown from zinc oxide particles usually having a particle size of from 0.1 to 2 microns or of at least smaller than 20 microns have a grain size usually between 10 and 20 microns. So, the effect of the addition of the zinc oxide seed grains appears with the grain size of the seed grains of at least 20 microns. On the other hand, if the grain size of the seed grains is larger than 200 microns, the distribution of the zinc oxide grains in the resultant sintered body loses its desired uniformity and density, although the C-value can be lowered by using seed grains having a larger grain size. By using seed grains having grain sizes distributed within the range of 20 to 200 microns, the C-value can be remarkably lowered without deteriorating other properties. The reason why the preferred grain size of the zinc oxide core grains is between 100 and 500 microns is similar to the reason why the preferred grain size of the zinc oxide seed grains is between 20 and 200 microns.

A preferred amount of the zinc oxide seed grains is from 0.1 to 60 weight percent on the basis of the total zinc oxide component. If the amount of the seed grains is too small, the distribution of the zinc oxide grains in the sintered body becomes undesirably non-uniform, and the residual voltage ratio $V_{10\,A}/V_{1\,mA}$, which will be described later, becomes undesirably high, and the surge energy withstanding capability of the sintered body becomes too low. On the other hand, if the amount of the seed grains is too large, the porosity of the resultant sintered body becomes too high, which leads to a decrease of the contact areas between adjacent zinc oxide grains in the sintered body, resulting in an increase of the C-value and of the residual voltage ratio $V_{10\,A}/V_{1\,mA}$ and in the deterioration of the surge energy withstanding capability and of the stability to the ambient humidity. By using such zinc oxide seed grains, the seed grains grow to core grains in an amount of 10 to 100 weight percent on the basis of the total zinc oxide component in the sintered body. If the amount of the zinc oxide core grains is too small, similar disadvantages to those appearing in the case of seed grains having a too small grain size appear, such as too low surge energy withstanding capability.

The zinc oxide seed grains to be used in the method of making a voltage-dependent resistor according to this invention can be made by pulverizing zinc oxide single crystals having a very large crystal size. However, more preferably, the zinc oxide seed grains are made by the following method. A zinc oxide powder having a particle size usually in the range of 0.1 to 2 microns is prepared in the first place. To the thus prepared zinc oxide powder as a starting zinc oxide powder, a grain growth promoting agent selected from amount barium oxide, strontium oxide, calcium oxide, sodium oxide, potassium oxide, rubidium oxide, praseodymium oxide, samarium oxide, niobium oxide, tantalum oxide, tungsten oxide, uranium oxide and bismuth oxide, is added in an amount that the starting zinc oxide powder is 95 to 99.9 mole percent (which may contain cobalt oxide, manganese oxide or nickel oxide as will be described later) and the grain growth promoting agent is 0.1 to 5 mole percent. If the amount of the grain growth promoting agent is too small, the starting zinc oxide powder particles do not sufficiently grow to seed grains, whereas the particle growth rate of the starting zinc oxide powder to seed grains levels off at a certain amount of the grain growth promoting agent, and thus an amount thereof exceeding the certain amount (5 mole percent) is unnecessary or rather decreases the production yield rate of the seed grains.

The mixture of the starting zinc oxide powder and the grain growth promoting agent is heated or fired at a temperature preferably between 1100° C. and 1600° C. for a time period preferably between 0.5 and 50 hours. If the firing temperature is too low or the firing time is too short, the starting zinc oxide powder does not grow to grains having a sufficiently large grain size as seed grains. On the other hand, the particle growth levels off at a certain temperature (1600° C.) or at a certain firing time (50 hours), and thus a firing temperature higher than 1600° C. and a firing time longer than 50 hours are unnecessary.

The desired zinc oxide seed grains can be made by pulverizing the thus made fired mixture and selecting grains in an appropriate grain size range with the aid of a sieve. In this case, the zinc oxide seed grains contain the slight amount of the grain growth promoting agent remaining therein. However, more preferably, a water soluble oxide is used, selected from amongst barium oxide, strontium oxide, calcium oxide, sodium oxide, potassium oxide and rubidium oxide in the above described amount, or more preferably in an amount of 0.3 to 0.8 mole percent on the basis of the sum of the starting zinc oxide powder and the grain growth promoting agent. The most preferred one is barium oxide in view of the grain growth of the starting zinc oxide powder and its water solubility. When the mixture of the starting zinc oxide powder and the water soluble grain growth promoting agent is compressed and fired, the grain growth promoting agent gathers at the grain boundaries of the zinc oxide seed grains in the fired mixture. So, by immersing the fired mixture in water or further boiling the water, the grain growth promoting agent can be dissolved into the water. That is, the grain growth promoting agent is removed by washing. Thereby, the fired mixture is broken at the grain boundaries into separate seed grains.

Since the thus obtained seed grains have a grain size mostly in the range between 20 and 200 microns, the seed grains can be made by such method with a yield rate of nearly 100%. In this case, if the amount of the water soluble promoting agent is too small, the starting zinc oxide powder does not sufficiently grow, whereas if the amount is too large, it is difficult to completely remove the water soluble grain growth promoting agent by washing. The seed grains produced by using and removing the water soluble grain growth promoting agent are better than the seed grains produced by using grain growth promoting agent and pulverizing the fired mixture, because the former seed grains are mainly composed of primary seed grains, whereas the latter seed grains often contain agglomerates of plural seed grains and/or broken seed grains, so that the former seed grains cause more uniform and homogeneous sintered body having zinc oxide core grains of a higher grain size in the resultant voltage-dependent resistor.

By using zinc oxide seed grains in the grain size range between 20 and 200 microns, voltage-dependent resistors having low C-values can be obtained. The C-value can be varied by selecting the grain size distribution of the seed grain in accordance with the desired use of the voltage-dependent resistors. When the resistors are used for absorbing so-called giant surges which may appear in automobiles, the C-values are preferably in the range of between 10 and 15 volts, and the residual voltage ratio $V_{10A}/V_{1mA}$ is preferably low. For this use, the desired grain size of the zinc oxide seed grains is in the range between 44 and 150 microns, and the amount of the seed grains in this case on the basis of the total zinc oxide component in the resultant sintered body is more preferably from 2 to 15 weight percent.

According to the above method, the starting zinc oxide powder need not necessarily to be pure. Generally, in voltage-dependent resistors using zinc oxide sintered bodies, when cobalt oxide, manganese oxide and/or nickel oxide is used as an additive for giving the sintered body a voltage-dependent property, such additive is partially dissolved in zinc oxide grains. Such additive can be preliminarily dissolved in the zinc oxide seed grains to form a solid solution by incorporating such additive into the starting zinc oxide powder before firing the mixture of the starting zinc oxide powder and the grain growth promoting agent. In this case, the preferred amounts of cobalt oxide, manganese oxide and nickel oxide are 0.1 to 15 mole percent, 0.1 to 5.0 mole percent and 0.1 to 30 mole percent, respectively.

Preferred additives to be added to the sintered body in conjunction with the zinc oxide seed grains and the fine zinc oxide powder are known oxides (or known fluorides of some of) magnesium, beryllium, calcium, strontium, barium, titanium, niobium, tantalum, chromium, tungsten, uranium, manganese, iron, cobalt, nickel, cadmium, boron, aluminum, gallium, indium, silicon, germanium, tin, lead, antimony, bismuth, lanthanum, praseodymium, neodymium and samarium. However, when the additives among them other than strontium oxide, barium oxide, manganese oxide, cobalt oxide and bismuth oxide are used, they are desired to be used in conjunction with at least one of these five oxides, in order to obtain practically sufficient voltage-dependent properties of the resultant resistors.

According to a further development of this invention, a voltage-dependent resistor having a low leakage current even at a high temperature can be obtained. That is, when the voltage-dependent resistor is used for absorbing giant surges in an automobile, it is required to have not only a low C-value or a low varistor voltage and a low residual voltage ratio $V_{10A}/V_{1mA}$, but also a high operating temperature such as 150° C., i.e. a low leakage current even at a high temperature such as 150° C. It is the discovery according to the further development of this invention that such low leakage current can be attained by adding antimony oxide without undesirably increasing the C-value or the varistor voltage. It is known that the leakage current at a high temperature can be reduced by the addition of antimony oxide. (When antimony oxide is used, bismuth oxide is usually used at the same time.) However, in a conventional voltage-dependent resistor, the addition of antimony oxide causes the conventional resistor to increase in its C-value. However, in the voltage-dependent resistor of this invention which has zinc oxide core grains in the grain size from 100 to 500 microns made from zinc oxide seed grains in the grain size from 20 to 200 microns, the addition of antimony oxide does not cause undesired increase of the C-value. This is presumably because the seed grains can grow to the core grains even in the presence of antimony oxide.

When antimony oxide is used and hence bismuth oxide is used at the same time, a preferred amount of each of antimony oxide and bismuth oxide is between 0.1 to 10 mole percent on the basis of the resultant sintered body. If the amount of each of these two oxides is too small, sufficient effects of the additions thereof do not appear. On the other hand, if the amount of antimony oxide is too large, the resultant C-value becomes undesirably high. If the amount of bismuth oxide is too large, when plural compressed bodies to be sintered are stacked on each other and sintered in a sintering furnace, the adjacent sinterd bodies are likely to be bonded to each other.

It is a further finding according to the further development of this invention that when antimony oxide is preliminarily mixed with a portion of the fine zinc oxide powder to be mixed with the zinc oxide seed grains and an additive or additives for giving the resultant sintered body voltage dependent properties, and is heated or fired to form a spinel type polycrystalline $Zn_{7/3}Sb_{2/3}O_4$, and when the thus made spinel compound is pulverized to granules, and the thus made granules are added to the remaining fine zinc oxide powder and the zinc oxide seed grains and the additive or additives, then the more or less undesired effect of the antimony oxide addition to increase the C-value of the resultant voltage-dependent resistor can more effectively be suppressed. Thereby, a lower C-value and a low leakage current at a high temperature can be attained.

The preferred heating temperature and time for making the spinel compound are between 1300° C. and 1400° C., and between 0.5 and 10 hours, respectively. If the heating temperature and time are too low and too short, respectively, the desired spinel phase is not sufficiently made, whereas an excessively higher temperature and longer time than 1400° C. and 10 hours, respectively, are simply unnecessary. The preferred granule size of the pulverized spinel compound is between 0.1 and 60 microns. If the granule size is too large, the residual voltage ratio $V_{10A}/V_{1mA}$ becomes undesirably high and the surge energy withstanding capability becomes undesirably low. On the other hand, if the granule size is too small, the effect of the use of the spinel compound to suppress the increase of the C-value does not appear.

In the case where 0.1 to 10 mole percent of antimony oxide and 0.1 to 10 mole percent of bismuth oxide are used, when at least one member of cobalt oxide, manganese oxide, chromium oxide and nickel oxide is also used in an amount that the amount of antimony oxide is between 99.2 and 7.7 mole percent on the basis of the sum of the antimony oxide and the above-mentioned at least one member, then the resultant voltage-dependent resistor can have better properties as a low C-value resistor for absorbing current surges. In this case, when the antimony oxide and the above-mentioned at least one member are mixed with a portion of the fine zinc oxide powder (to be mixed with the zinc oxide seed grains and an additives or additive for giving the resistor a voltage-dependent property) and heated or sintered to form a sintered powder mainly of a spinel type polycrystalline compound, then the addition of such sintered powder to the remaining fine zinc oxide powder and the zinc oxide seed grains and the additive or additives causes the resultant resistor to have a lower C-value, a higher surge energy withstanding capability and a higher n-value than in the case when the spinel type compound is only of $Zn_{7/3}Sb_{2/3}O_4$. In this case, the heating temperature and time for obtaining the sintered powder mainly of the spinel type polycrystalline material are preferably between 1100° and 1400° C. and between 0.5 and 20 hours, respectively. If the heating temperature is too low, the sintered powder mainly of the spinel type polycrystalline material cannot be made stably. On the other hand, an excessively high temperature, i.e. higher than 1400° C., is simply unnecessary. The granule size or the particle size of the sintered powder (this can be obtained by pulverizing the sintered mixture) is preferably between 0.1 and 60 microns for similar reasons to those why the granule size of the single use of the spinel type polycrystalline $Zn_{7/3}Sb_{2/3}O_4$ is preferably between 0.1 and 60 microns as set forth above. Herein, the sintered powder mainly of the spinel type material or the single phase powder of spinel type $Zn_{7/3}Sb_{2/3}O_4$ is designated by spinel powder, SP.

This invention will more readily be understood with reference to the following Examples 1 to 12, but these Examples are intended only to illustrate this invention, and are not to be construed to limit the scope of this invention. (In the Examples, the C-value is designated by a voltage across each sintered body at 1 mA/cm$^2$ of applied current per 1 mm thickness of the sintered body.)

EXAMPLE 1

Zinc oxide with additives as shown in Table 1 were mixed in an agate mortar for 3 hours. Each of the thus made mixtures was pressed into a mold disc of 40 mm in diameter and 5 mm in thickness under a pressure of 250 kg/cm$^2$ to a compressed body. Each of the thus compressed bodies was sintered in air at 1400° C. for 10 hours, and then furnace-cooled to room temperature. The sintered body was crushed into powder by an agate pestle, and then the thus made powders of 44 to 150 microns in diameter from each body were selected by sieves. The thus selected powders are designated as SG (seed grains).

On the other hand, a zinc oxide powder having an average particle size of 0.8 micron was mixed with additives as shown in Table 2 in an agate mortar for 3 hours. Each of the thus made mixtures is designated as BP (basic powder). 10 weight parts of SG was mixed with 99 weight parts of BP, and the mixture was mixed in a wet mill with resin balls for 24 hours. The mixture was dried and pressed into a mold disc of 17 mm in diameter and 1 to 3 mm in thickness under a pressure of 250 kg/cm$^2$ into a compressed body. Each of the thus compressed bodies was sintered in air at 1350° C. for 5 hours, and then furnace-cooled to room temperature, and was then lapped to a suitable thickness. The opposite major surfaces of each of the thus sintered and lapped bodies were provided with a spray metallized film of aluminum, as electrodes, by a per se well known technique.

On the other hand, sintered bodies with electrodes similar to those prepared above were prepared, except that in this case no SG was used for comparison.

The measured electrical characteristics of each of the thus made various sintered bodies are shown in Tables 3 and 4. It is apparent from Tables 3 and 4 that the C-value decreases with the addition of SG without appreciably degrading n-value and the residual voltage ratio, which are proper characteristics of BP, and that the energy withstanding capability increases with the addition of SG. Herein, the residual voltage ratio $V_{10A}/V_{1mA}$ means the ratio of the voltage across the sintered body supplied with the current of 10 A/cm$^2$ to the voltage across the sintered body supplied with the current of 1 mA/cm$^2$. Therefore, it is better for a surge absorber to have a smaller residual voltage. The surge energy withstanding capability E means the destruction energy of the sintered bodies with electrodes of 1 cm in diameter when the surge is applied to the sintered body the varistor voltage (which means the voltage across the sintered body when the current of 1 mA/cm$^2$ is applied) of which is adjusted to 20 volts. It will be readily recognized that the addition of SG improves the C-value and the energy withstanding capability without degrading the inherent n-value and residual voltage ratio for each material composition.

EXAMPLE 2

Zinc oxide and additives as shown by samples Nos. A to F in Table 1 were fabricated into the SG by the same method as that of Example 1, except that in this Example 2, SG was made by washing and boiling in pure water for 10 hours the sintered bodies produced by using water soluble grain growth promoting agents. Various mixtures of zinc oxide with SG and additives as shown in Table 2 were fabricated into the sintered bodies with electrodes by the same method as that of Example 1, except that in this Example 2, the SG was made by washing and boiling the sintered bodies in pure water as described above.

The electrical characteristics of the thus made various sintered bodies are shown in Table 5. It is apparent from Table 5 that the C-values can be lowered from those in Example 1 by using the SG made by washing and boiling the sintered bodies in pure water employing water soluble grain growth promoting agents. The n-value and residual voltage ratio change only slightly. The energy withstanding capability increases in comparison to the results of Example 1. It can be easily understood that the addition of SG made by washing and boiling in pure water the sintered bodies employing water soluble grain growth promoting agents improves the C-value and the energy withstanding capability.

EXAMPLE 3

Zinc oxide and additives as shown by sample Nos. A and B in Table 1 were fabricated into the SG by the same method as that of Example 2. Zinc oxide with SG and additives as shown in Table 2, sample No. 2, were fabricated into the sintered bodies with electrodes by the same method as that of Example 1, except that the amount of SG in this Example 3 was varied from zero to 80 weight percent.

The electrical characteristics of the thus made various sintered bodies are shown in Table 6. It is apparent from Table 6 that C-value, residual voltage ratio and the energy withstand capability changes with the amount of the added SG. It can be understood that the addition of SG of less than 0.1 weight percent and more than 60 weight percent causes an undesired decrease of the energy withstanding capability and increase of the residual voltage ratio.

EXAMPLE 4

Zinc oxide and additives as shown in Table 1, sample No. A, were fabricated into the SG by the same method as that of Example 2, except that the grain size of SG in this Example 4 was varied from less than 20 microns to more than 200 microns. Then, zinc oxide and additives as shown in Table 2, sample No. 2, were fabricated into the sintered bodies with electrodes by the same method as that of Example 1, except that the grain size of the added SG in this Example 4 was varied from less than 20 microns to more than 200 microns.

The electrical characteristics of the thus made various sintered bodies are shown in Table 7. It is apparent from Table 7 that C-value, the energy withstanding capability and residual voltage ratio change with the grain size of the added SG. It can be understood that the addition of SG of less than 20 microns and more than 200 microns are not preferred for obtaining excellent C-value, energy withstanding capability and residual voltage ratio.

EXAMPLE 5

Zinc oxide and additives in Table 1, sample No. A, were fabricated into the SG by the same method as that of Example 2, except that the amount of the additive in this Example 5 was varied from zero to 10 mole percent.

The production yield rate of SG from 20 microns to 200 microns as shown in Table 8. It is apparent from Table 8 that the addition of additive of less than 0.1 mole % and the addition of the additive of more than 5 mole % cause poor yield rate in production of the SG having a grain size useful for improving the electrical characteristics of the resultant sintered bodies with electrodes.

EXAMPLE 6

Zinc oxide and additives in Table 1, sample No. A, were fabricated into SG by the same method as that of Example 2, except that the sintering temperature and the sintering time in this Example 6 were varied from 1000° C. to 1600° C. and from 0.5 hour to 50 hours, respectively.

The production yield rate of SG having a grain size in the range from 20 microns to 200 microns are shown in Table 9. It is apparent from Table 9 that the sintering at a temperature lower than 1100° C. and for a time period of shorter than 0.5 hour causes a poor production yield rate of SG because of poor growth of the ZnO grains. The sintering at a temperature higher than 1600° C. causes saturation of the grain growth, so that temperatures higher than 1600° C. cause little improvement of SG production yield rate in comparison with 1600° C. The sintering for a time period shorter than 0.5 hour causes little grain growth, resulting in poor production yield rate. On the other hand, the sintering for a time period longer than 50 hours causes the saturation of the grain growth, so that the sintering time longer than 50 hours causes little improvement in the SG production yield rate in comparison with 50 hours.

EXAMPLE 7

Zinc oxide and additives in Table 1, sample No. A, were fabricated into SG by the same method as that of Example 2.

Zinc oxide with SG and additives as shown in Table 10 were fabricated into the sintered bodies with electrodes by the same method as that of Example 1.

The electrical characteristics of the thus made various sintered bodies are shown in Table 11, which shows the leakage current characteristics in addition to the C-value, n-value, residual voltage ratio and surge energy withstanding capability. Herein, the leakage current is a current flowing through the sintered body when 80 percent of its varistor voltage ($V_{1mA}$) is applied to the sintered body at 150° C. For attaining high temperature operation, the leakage current is required to be smaller. It is desired that the leakage current defined herein be smaller than 100 μA. By comparing the leakage current characteristics of the materials made from BP using $Sb_2O_3$ with those not using $Sb_2O_3$, it can be readily understood that the addition of $Sb_2O_3$ improves the leakage current characteristics.

EXAMPLE 8

Zinc oxide and additives in Table 1, sample No. A, were fabricated into SG by the same method as that of Example 2.

Meanwhile, antimony oxide as shown in Table 10, sample Nos. 27 to 31, was mixed with a portion of fine zinc oxide. The ratio of antimony oxide to zinc oxide was 7 to 1 in molar ratio. The mixed powders were sintered in air at 1350° C. for 2 hours, and then furnace-cooled to room temperature. The sintered powders were crushed by an agate pestle, and then the powders of smaller than 60 microns and larger than 0.1 microns in diameter were selected by sieves. The powders were composed of spinel type polycrystalline (SP) $Zn_{7/3}Sb_{2/3}O_4$.

The rest of the fine zinc oxide powder and additives as shown in Table 10, sample Nos. 27 to 31, were mixed with the above prepared SG and SP (employing the same amount of $Sb_2O_3$). The thus made mixtures were fabricated into the sintered bodies with electrodes by the same method as that of Example 1.

The measured electrical characteristics of the thus made various sintered bodies are shown in Table 12, which shows better C-values and energy withstanding capabilities than in the case when $Sb_2O_3$ is used without any preliminary preparation of the spinel type polycrystalline $Zn_{7/3}Sb_{2/3}O_4$. It can be understood that by adding the $Sb_2O_3$ in the form of $Zn_{7/3}Sb_{2/3}O_4$, the C-value and energy withstanding capability are improved without deteriorating other electrical properties.

EXAMPLE 9

Zinc oxide and additives in Table 1, sample No. A, were fabricated into SG by the same method as that of Example 2.

Meanwhile, antimony oxide (and a portion of zinc oxide powder for BP) as shown in Table 10, sample No. 28, was fabricated into SP by the same method as that of Example 8, except that the granule size of the added SP in the Example 9 was varied from 0.1 to 60 microns.

The rest of the zinc oxide powder and the additives as shown in Table 10, sample No. 28, were mixed with SG and SP, and the thus made mixtures were fabricated into the sintered bodies with electrodes by the same method as that of Example 8.

The electrical characteristics of the thus made sintered bodies are shown in Table 13. It is apparent from Table 13 that the residual voltage ratio becomes undesirably high by adding the SP having a granule size larger than 60 microns. It can be understood that by adding the SP having a granule size in the range from 0.1 to 60 microns, the residual voltage ratio is improved without degrading the leakage current characteristics.

EXAMPLE 10

Zinc oxide and additives in Table 1, sample No. A, were fabricated into SG by the same method as that of Example 2.

Meanwhile, antimony oxide (and a portion of zinc oxide powder for BP) as shown in Table 10, sample No. 28, were fabricated into SP by the same method as that of Example 8, except that the sintering temperature and time in this Example 10 were from 1200° C. to 1400° C. and for from 0.5 hour to 10 hours, respectively.

The rest of the zinc oxide powder and the additives in Table 10, sample No. 28, were mixed with SG and SP, and the thus made mixtures were fabricated into the sintered bodies with electrodes by the same method as that of Example 8.

The electrical characteristics of the thus made sintered bodies are shown in Table 14. It is apparent from Table 14 that the SP obtained by being sintered at a temperature lower than 1300° C. or for a time shorter than 0.5 hour causes undesirably high C-value and low energy withstanding capability, and that the SP obtained by being sintered at a temperature higher than 1400° C. or for a time period longer than 10 hours does not cause much improvement of C-value and the energy withstanding capability than by a temperature of 1400° C. or a time period of 10 hours.

Example 11

Zinc oxide and additives in Table 15, sample Nos. A and N to Q, were fabricated into SG by the same method as that of Example 2, except that the additives in this Example 11 were those as shown in Table 15.

Zinc oxide and the additives as shown in Table 2, sample No. 2, and SG were fabricated into the sintered bodies with electrodes by the same method as that of Example 1, except that the additives for SG in this Example 11 were as shown in Table 15.

The electrical characteristics of the thus made sintered bodies are shown in Table 16, which shows improvement of n-values in comparison with those of the sintered bodies made by SG without further additives (except barium oxide) as shown in Table 15. It can be understood that the addition of cobalt oxide, manganese oxide or nickel oxide to SG causes improvement of the n-value without degrading other electrical properties.

Example 12

Zinc oxide and additives in Table 1, sample No. A, were fabricated into SG by the same method as that of Example 2.

Meanwhile, antimony oxide and a portion of zinc oxide for BP and additives as shown in Table 17 were mixed. The thus made mixtures were fabricated into SP by the same method as that of Example 8, except that the additives for SP in this Example 12 were those as shown in Table 17.

The rest of the zinc oxide powder and additives as shown in Table 10, sample No. 28, were mixed with SG and SP composed of the same amount of $Sb_2O_3$ and fabricated into the sintered body with electrodes by the same method as that of Example 1, except that the SP in this Example 12, was composed of zinc oxide, antimony oxide and one of cobalt oxide, manganese oxide, nickel oxide and chromium oxide.

The electrical characteristics of the thus made sintered bodies are shown in Table 18, which shows better n-values in comparison with those of the sintered bodies with SP without a further additive of cobalt oxide, manganese oxide, nickel oxide or chromium oxide. It can be understood that the further addition of cobalt oxide, manganese oxide, chromium oxide or nickel oxide for SP improves the n-value without degrading other electrical properties.

While particular embodiments of this invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

Table 1

| Sample No. of SG | Additives (mole Percent) | | | | | | | | | | | | |
|---|---|---|---|---|---|---|---|---|---|---|---|---|---|
| | BaO | SrO | CaO | $Na_2O$ | $K_2O$ | $Rb_2O$ | $Pr_2O_3$ | $Sm_2O_3$ | $Nb_2O_5$ | $Ta_2O_5$ | $WO_3$ | $UO_2$ | $Bi_2O_3$ |
| A | 0.5 | | | | | | | | | | | | |
| B | | 0.5 | | | | | | | | | | | |
| C | | | 0.5 | | | | | | | | | | |
| D | | | | 0.5 | | | | | | | | | |
| E | | | | | 0.5 | | | | | | | | |
| F | | | | | | 0.5 | | | | | | | |
| G | | | | | | | 0.5 | | | | | | |
| H | | | | | | | | 0.5 | | | | | |
| I | | | | | | | | | 0.5 | | | | |
| J | | | | | | | | | | 0.5 | | | |
| K | | | | | | | | | | | 0.5 | | |
| L | | | | | | | | | | | | 0.5 | |
| M | | | | | | | | | | | | | 0.5 |

Table 2

| Sample No. of BP | Additives (mole percent) | | | | | | | | | | | | | | | |
|---|---|---|---|---|---|---|---|---|---|---|---|---|---|---|---|---|
| | ZnO | $Bi_2O_3$ | $Co_2O_3$ | $MnO_2$ | $Sb_2O_3$ | $Cr_2O_3$ | NiO | $TiO_2$ | $SiO_2$ | MgO | BaO | $La_2O_3$ | $Pr_2O_3$ | $SnO_2$ | $B_2O_3$ | Others |
| 1 | 98.0 | 0.5 | 0.5 | 0.5 | 0.5 | | | | | | | | | | | |
| 2 | 97.3 | 0.5 | 0.5 | 0.5 | 1.0 | 0.2 | | | | | | | | | | |
| 3 | 95.2 | 0.5 | 0.5 | 0.5 | 1.0 | 0.5 | 1.0 | | 0.3 | 0.5 | | | | | | |
| 4 | 97.0 | 0.5 | 0.5 | 0.5 | | | 1.0 | 0.5 | | | | | | | | |
| 5 | 99.0 | | 0.5 | | | | | | | | 0.5 | | | | | |
| 6 | 97.3 | | 2.0 | | | | | | | | | 0.2 | 0.5 | | | |
| 7 | 98.0 | 0.5 | 0.5 | 0.5 | | | | | | | | | | 0.5 | | |
| 8 | 75.0 | 2.0 | 1.0 | 0.5 | 3.5 | 0.5 | | | 0.5 | 17.0 | | | | | | |
| 9 | 96.65 | 0.5 | 0.5 | 0.5 | 1.0 | 0.5 | | | 0.25 | | 0.1 | | | | 0.1 | |
| 10 | 95.4 | 1.0 | 0.5 | 0.5 | 1.0 | 0.1 | 1.0 | | | | | | | | | BeO 0.5 |
| 11 | 96.4 | 1.0 | 0.5 | 0.5 | 1.0 | 0.1 | | | | | | | | | | CaO 0.5 |
| 12 | 96.4 | 1.0 | 0.5 | 0.5 | 1.0 | 0.1 | | | | | | | | | | SrO 0.5 |
| 13 | 95.9 | 0.5 | 0.5 | 0.5 | 1.0 | 0.1 | 1.0 | | | | | | | | | $Nb_2O_5$ 0.5 |
| 14 | 95.9 | 0.5 | 0.5 | 0.5 | 1.0 | 0.1 | 1.0 | | | | | | | | | $Ta_2O_5$ 0.5 |
| 15 | 95.9 | 0.5 | 0.5 | 0.5 | 1.0 | 0.1 | 1.0 | | | | | | | | | $WO_3$ 0.5 |
| 16 | 95.9 | 0.5 | 0.5 | 0.5 | 1.0 | 0.1 | 1.0 | | | | | | | | | $UO_2$ 0.5 |
| 17 | 96.4 | 1.0 | 0.5 | 0.5 | 1.0 | 0.1 | | | | | | | | | | $Fe_2O_3$ 0.5 |
| 18 | 96.4 | 1.0 | 0.5 | 0.5 | 1.0 | 0.1 | | | | | | | | | | CdO 0.5 |
| 19 | 95.89 | 1.0 | 0.5 | 0.5 | 1.0 | 0.1 | 1.0 | | | | | | | | | $Al_2O_3$ 0.01 |
| 20 | 95.89 | 1.0 | 0.5 | 0.5 | 1.0 | 0.1 | 1.0 | | | | | | | | | $Ga_2O_3$ 0.01 |
| 21 | 95.89 | 1.0 | 0.5 | 0.5 | 1.0 | 0.1 | 1.0 | | | | | | | | | $In_2O_3$ 0.01 |
| 22 | 96.4 | 1.0 | 0.5 | 0.5 | 1.0 | 0.1 | | | | | | | | | | $GeO_2$ 0.5 |
| 23 | 96.4 | 1.0 | 0.5 | 0.5 | 1.0 | 0.1 | | | | | | | | | | PbO 0.5 |
| 24 | 96.9 | 0.5 | 0.5 | 0.5 | 1.0 | 0.1 | | | | | | | | | | $Nd_2O_3$ 0.5 |
| 25 | 96.9 | 0.5 | 0.5 | 0.5 | 1.0 | 0.1 | | | | | | | | | | $Sm_2O_3$ 0.5 |

Table 3

| Sample No. of BP | Electrical Characteristics | | | |
|---|---|---|---|---|
| | C-value (V) | n-value | $V_{10A}/V_{1mA}$ | E(Joule) |
| 1 | 123 | 44 | 1.6 | 12 |
| 2 | 118 | 45 | 1.5 | 12 |
| 3 | 133 | 47 | 1.5 | 12 |
| 4 | 35 | 28 | 2.0 | 25 |
| 5 | 55 | 18 | 2.0 | 22 |
| 6 | 125 | 25 | 1.6 | 12 |
| 7 | 90 | 35 | 1.6 | 18 |
| 8 | 151 | 45 | 1.6 | 6 |
| 9 | 120 | 45 | 1.6 | 12 |
| 10 | 105 | 40 | 1.6 | 12 |

Table 3-continued

| Sample No. of BP | Electrical Characteristics | | | |
|---|---|---|---|---|
| | C-value (V) | n-value | $V_{10A}/V_{1mA}$ | E(Joule) |
| 11 | 120 | 43 | 1.6 | 12 |
| 12 | 123 | 43 | 1.7 | 12 |
| 13 | 118 | 45 | 1.7 | 12 |
| 14 | 123 | 40 | 1.6 | 12 |
| 15 | 115 | 38 | 1.7 | 12 |
| 16 | 116 | 39 | 1.7 | 12 |
| 17 | 121 | 40 | 1.6 | 12 |
| 18 | 126 | 33 | 1.6 | 12 |

Table 3-continued

| Sample No. of BP | Electrical Characteristics | | | |
|---|---|---|---|---|
| | C-value (V) | n-value | $V_{10A}/V_{1mA}$ | E(Joule) |
| 19 | 118 | 30 | 1.5 | 12 |
| 20 | 120 | 31 | 1.5 | 12 |
| 21 | 124 | 33 | 1.5 | 12 |
| 22 | 115 | 40 | 1.7 | 12 |
| 23 | 119 | 31 | 1.7 | 12 |
| 24 | 121 | 35 | 1.6 | 12 |
| 25 | 121 | 37 | 1.6 | 12 |

Table 4

| Sample No. of SG | Sample No. of BP | Electrical Characteristics | | | |
|---|---|---|---|---|---|
| | | C-Value (V) | n-value | $V_{10A}/V_{1mA}$ | E(Joule) |
| | 1 | 32 | 42 | 1.6 | 65 |
| | 2 | 33 | 45 | 1.6 | 67 |
| | 3 | 38 | 47 | 1.6 | 51 |
| | 4 | 21 | 27 | 2.0 | 80 |
| | 5 | 24 | 19 | 2.0 | 75 |
| | 6 | 36 | 24 | 1.6 | 53 |
| | 7 | 30 | 33 | 1.7 | 56 |
| | 8 | 39 | 45 | 1.6 | 50 |
| | 9 | 33 | 41 | 1.6 | 58 |
| | 10 | 30 | 38 | 1.6 | 63 |
| A | 11 | 33 | 43 | 1.6 | 59 |
| | 12 | 32 | 40 | 1.7 | 58 |
| | 13 | 29 | 40 | 1.7 | 67 |
| | 14 | 29 | 38 | 1.7 | 67 |
| | 15 | 25 | 35 | 1.7 | 69 |
| | 16 | 27 | 39 | 1.8 | 66 |
| | 17 | 33 | 40 | 1.6 | 58 |
| | 18 | 33 | 30 | 1.7 | 58 |
| | 19 | 30 | 30 | 1.6 | 63 |
| | 20 | 31 | 28 | 1.5 | 55 |
| | 21 | 32 | 30 | 1.5 | 52 |
| | 22 | 27 | 35 | 1.7 | 70 |
| | 23 | 27 | 31 | 1.7 | 63 |
| | 24 | 30 | 35 | 1.6 | 61 |
| | 25 | 30 | 35 | 1.6 | 61 |
| | 1 | 36 | 44 | 1.6 | 53 |
| B | 2 | 36 | 46 | 1.6 | 53 |
| | 5 | 25 | 18 | 2.0 | 70 |
| | 6 | 38 | 24 | 1.7 | 54 |
| | 1 | 38 | 40 | 1.8 | 54 |
| C | 2 | 37 | 45 | 1.7 | 53 |
| | 5 | 26 | 15 | 2.2 | 65 |
| | 6 | 40 | 20 | 1.8 | 51 |
| | 1 | 38 | 30 | 1.8 | 55 |
| D | 2 | 37 | 35 | 1.7 | 53 |
| | 5 | 27 | 16 | 2.1 | 63 |
| | 6 | 39 | 20 | 1.8 | 52 |
| | 1 | 39 | 35 | 1.8 | 51 |
| E | 2 | 37 | 35 | 1.8 | 53 |
| | 5 | 25 | 20 | 1.9 | 63 |
| | 6 | 38 | 22 | 1.8 | 51 |
| | 1 | 37 | 30 | 1.9 | 51 |
| F | 2 | 35 | 33 | 1.8 | 53 |
| | 5 | 25 | 21 | 2.2 | 62 |
| | 6 | 38 | 23 | 1.8 | 54 |
| | 1 | 36 | 43 | 1.6 | 55 |
| G | 2 | 36 | 45 | 1.5 | 54 |
| | 5 | 24 | 18 | 2.0 | 72 |
| | 6 | 37 | 21 | 1.6 | 53 |
| | 1 | 39 | 40 | 1.7 | 53 |
| H | 2 | 40 | 46 | 1.8 | 51 |
| | 5 | 26 | 16 | 2.0 | 61 |
| | 6 | 40 | 21 | 1.8 | 51 |
| | 1 | 36 | 43 | 1.7 | 53 |
| I | 2 | 35 | 45 | 1.6 | 55 |
| | 5 | 23 | 19 | 2.1 | 71 |
| | 6 | 39 | 23 | 1.7 | 53 |
| | 1 | 36 | 44 | 1.7 | 53 |
| J | 2 | 35 | 43 | 1.7 | 53 |
| | 5 | 23 | 19 | 2.0 | 67 |
| | 6 | 39 | 21 | 1.7 | 52 |
| | 1 | 35 | 40 | 1.6 | 55 |
| K | 2 | 34 | 45 | 1.6 | 55 |
| | 5 | 23 | 16 | 2.0 | 60 |

Table 4-continued

| Sample No. of SG | Sample No. of BP | Electrical Characteristics C-Value (V) | n-value | $V_{10A}/V_{1mA}$ | E(Joule) |
|---|---|---|---|---|---|
| | 6 | 40 | 23 | 1.6 | 52 |
| | 1 | 38 | 35 | 1.7 | 51 |
| L | 2 | 38 | 35 | 1.7 | 53 |
| | 5 | 26 | 16 | 2.0 | 63 |
| | 6 | 38 | 30 | 1.7 | 52 |
| | 1 | 33 | 46 | 1.6 | 57 |
| M | 2 | 40 | 46 | 1.5 | 51 |
| | 5 | 25 | 23 | 2.0 | 62 |
| | 6 | 39 | 26 | 1.6 | 53 |

Table 5

| Sample No. of SG | Sample No. of BP | Electrical Characteristics C-value (V) | n-value | $V_{10A}/V_{1mA}$ | E(Joule) |
|---|---|---|---|---|---|
| | 1 | 13 | 41 | 1.6 | 101 |
| | 2 | 15 | 46 | 1.5 | 96 |
| | 3 | 16 | 46 | 1.7 | 108 |
| | 4 | 9 | 25 | 2.0 | 128 |
| | 5 | 10 | 18 | 2.0 | 120 |
| | 6 | 12 | 25 | 1.7 | 108 |
| | 7 | 10 | 34 | 1.7 | 120 |
| | 8 | 13 | 46 | 1.7 | 103 |
| | 9 | 12 | 46 | 1.7 | 104 |
| | 10 | 12 | 39 | 1.7 | 105 |
| | 11 | 12 | 40 | 1.6 | 105 |
| | 12 | 13 | 40 | 1.6 | 105 |
| A | 13 | 12 | 41 | 1.7 | 107 |
| | 14 | 12 | 41 | 1.6 | 101 |
| | 15 | 12 | 41 | 1.7 | 103 |
| | 16 | 12 | 40 | 1.7 | 101 |
| | 17 | 13 | 35 | 1.7 | 104 |
| | 18 | 13 | 35 | 1.7 | 100 |
| | 19 | 13 | 28 | 1.7 | 105 |
| | 20 | 13 | 29 | 1.6 | 121 |
| | 21 | 13 | 31 | 1.6 | 115 |
| | 22 | 12 | 35 | 1.7 | 113 |
| | 23 | 12 | 29 | 1.7 | 107 |
| | 24 | 13 | 34 | 1.6 | 106 |
| | 25 | 13 | 36 | 1.6 | 105 |
| | 1 | 15 | 44 | 1.6 | 90 |
| | 2 | 17 | 45 | 1.6 | 90 |
| | 3 | 18 | 40 | 1.5 | 83 |
| | 4 | 11 | 30 | 2.1 | 114 |
| | 5 | 12 | 19 | 1.9 | 123 |
| | 6 | 13 | 26 | 1.7 | 114 |
| | 7 | 12 | 35 | 1.7 | 120 |
| | 8 | 13 | 40 | 1.6 | 110 |
| | 9 | 15 | 41 | 1.6 | 85 |
| | 10 | 15 | 33 | 1.6 | 88 |
| | 11 | 15 | 37 | 1.6 | 93 |
| | 12 | 15 | 37 | 1.7 | 90 |
| B | 13 | 14 | 40 | 1.6 | 90 |
| | 14 | 14 | 41 | 1.7 | 91 |
| | 15 | 14 | 30 | 1.7 | 92 |
| | 16 | 14 | 30 | 1.7 | 93 |
| | 17 | 15 | 31 | 1.6 | 90 |
| | 18 | 14 | 35 | 1.6 | 91 |
| | 19 | 14 | 30 | 1.5 | 91 |
| | 20 | 15 | 31 | 1.6 | 93 |
| | 21 | 15 | 30 | 1.5 | 97 |
| | 22 | 15 | 39 | 1.7 | 94 |
| | 23 | 14 | 31 | 1.7 | 95 |
| | 24 | 15 | 33 | 1.7 | 95 |
| | 25 | 15 | 36 | 1.7 | 90 |
| | 1 | 18 | 43 | 1.7 | 80 |
| | 2 | 16 | 45 | 1.7 | 95 |
| | 3 | 20 | 45 | 1.5 | 83 |
| | 4 | 13 | 30 | 2.1 | 108 |
| C | 5 | 13 | 15 | 2.0 | 120 |
| | 6 | 15 | 30 | 1.8 | 120 |
| | 7 | 14 | 35 | 1.8 | 108 |
| | 8 | 15 | 40 | 1.6 | 88 |
| | 9 | 15 | 40 | 1.7 | 92 |
| | 10 | 15 | 41 | 1.7 | 91 |
| | 1 | 17 | 39 | 1.7 | 85 |
| D | 2 | 17 | 45 | 1.6 | 87 |

Table 5-continued

| Sample No. of SG | Sample No. of BP | Electrical Characteristics C-value (V) | n-value | $V_{10A}/V_{1mA}$ | E(Joule) |
|---|---|---|---|---|---|
| | 5 | 17 | 18 | 2.0 | 89 |
| | 6 | 15 | 26 | 1.7 | 90 |
| | 1 | 17 | 41 | 1.6 | 92 |
| E | 2 | 18 | 43 | 1.6 | 90 |
| | 5 | 12 | 19 | 2.0 | 110 |
| | 6 | 14 | 26 | 1.7 | 103 |
| | 1 | 15 | 39 | 1.7 | 93 |
| F | 2 | 16 | 46 | 1.6 | 91 |
| | 5 | 15 | 17 | 1.9 | 95 |
| | 6 | 16 | 26 | 1.7 | 91 |

Table 6

| Sample No. of BP | Sample No. of SG | Amount of additive to SG (mole %) | Electrical Characteristics C-Value (V) | n-value | $V_{10A}/V_{1mA}$ | E(Joule) |
|---|---|---|---|---|---|---|
| | | 0.05 | 63 | 45 | 1.9 | 24 |
| | | 0.1 | 28 | 44 | 1.7 | 72 |
| | | 1 | 16 | 45 | 1.6 | 75 |
| | | 2 | 15 | 45 | 1.5 | 94 |
| | | 5 | 15 | 46 | 1.5 | 95 |
| | A | 10 | 15 | 46 | 1.5 | 96 |
| | | 15 | 15 | 45 | 1.5 | 95 |
| | | 20 | 16 | 46 | 1.5 | 78 |
| | | 40 | 17 | 45 | 1.5 | 73 |
| | | 60 | 18 | 45 | 1.6 | 63 |
| | | 80 | 25 | 43 | 2.5 | 35 |
| 2 | | | | | | |
| | | 0.05 | 69 | 45 | 1.9 | 25 |
| | | 0.1 | 35 | 44 | 1.7 | 65 |
| | | 1 | 19 | 44 | 1.6 | 84 |
| | | 2 | 17 | 45 | 1.5 | 86 |
| | | 5 | 17 | 45 | 1.5 | 89 |
| | B | 10 | 17 | 46 | 1.6 | 90 |
| | | 15 | 17 | 45 | 1.6 | 90 |
| | | 20 | 18 | 45 | 1.6 | 77 |
| | | 40 | 19 | 44 | 1.6 | 65 |
| | | 60 | 20 | 43 | 1.7 | 51 |
| | | 80 | 31 | 43 | 2.4 | 30 |

Table 7

| Sample No. of BP | Sample No. of SG | Grain size (microns) | Electrical Characteristics C-Value (V) | n-value | $V_{10A}/V_{1mA}$ | E(Joule) |
|---|---|---|---|---|---|---|
| | | less than 20 | 45 | 45 | 1.5 | 36 |
| | | 20 to 44 | 25 | 46 | 1.5 | 78 |
| 2 | A | 44 to 105 | 15 | 47 | 1.5 | 96 |
| | | 105 to 150 | 11 | 47 | 1.5 | 118 |
| | | 150 to 200 | 9 | 46 | 1.5 | 85 |
| | | more than 200 | 7 | 45 | 2.3 | 42 |

Table 8

| Sample No. of SG | Amount of additive to SG (mole %) | Yield rate of SG (weight percent) |
|---|---|---|
| | 0.05 | 45 |
| | 0.1 | 83 |
| | 0.3 | 97 |
| A | 0.8 | 97 |
| | 2.0 | 88 |
| | 5.0 | 81 |
| | 10.0 | 36 |

Table 9

| Sample No. of SG | Sintering temperature (°C.) | Sintering time (hours) | Yield rate of SG (weight percent) |
|---|---|---|---|
| | 1000° C. | 0.5 | 23 |
| | | 10 | 39 |
| | | 50 | 48 |
| | 1100° C. | 0.5 | 75 |
| | | 10 | 83 |
| | | 50 | 94 |
| | 1200° C. | 0.5 | 80 |
| A | | 10 | 88 |
| | | 50 | 96 |
| | 1400° C. | 0.5 | 90 |
| | | 10 | 97 |
| | | 50 | 99 |
| | 1600° C. | 0.5 | 97 |
| | | 10 | 98 |
| | | 50 | 99 |

Table 10

| Sample No. of BP | Additives (mole percent) | | | | | | | | | |
|---|---|---|---|---|---|---|---|---|---|---|
| | ZnO | $Bi_2O_3$ | $Co_2O_3$ | $MnO_2$ | $Sb_2O_3$ | NiO | $Cr_2O_3$ | $SnO_2$ | $TiO_2$ | BeO |
| 26 | 96.9 | 1.0 | 0.5 | 0.5 | | 1.0 | 0.1 | | | |
| 27 | 96.8 | 1.0 | 0.5 | 0.5 | 0.1 | 1.0 | 0.1 | | | |
| 28 | 95.9 | 1.0 | 0.5 | 0.5 | 1.0 | 1.0 | 0.1 | | | |
| 29 | 93.9 | 1.0 | 0.5 | 0.5 | 3.0 | 1.0 | 0.1 | | | |
| 30 | 91.9 | 1.0 | 0.5 | 0.5 | 5.0 | 1.0 | 0.1 | | | |
| 31 | 86.9 | 1.0 | 0.5 | 0.5 | 10.0 | 1.0 | 0.1 | | | |
| 32 | 99.0 | 0.5 | 0.5 | | | | | | | |
| 33 | 98.5 | 0.5 | 0.5 | | 0.5 | | | | | |
| 34 | 98.0 | 0.5 | 0.5 | 0.5 | | | | 0.5 | | |
| 35 | 97.0 | 0.5 | 0.5 | 0.5 | 1.0 | | | 0.5 | | |
| 36 | 97.0 | 0.5 | 0.5 | 0.5 | | 1.0 | | | 0.5 | |
| 37 | 96.9 | 0.5 | 0.5 | 0.5 | 0.1 | 1.0 | | | 0.5 | |
| 38 | 97.5 | 0.5 | 0.5 | 0.5 | | | | 0.5 | 0.5 | |
| 39 | 97.4 | 0.5 | 0.5 | 0.5 | 0.1 | | | 0.5 | 0.5 | |
| 40 | 98.0 | 0.5 | 0.5 | 0.5 | | | | | | 0.5 |
| 41 | 97.9 | 0.5 | 0.5 | 0.5 | 0.1 | | | | | 0.5 |
| 42 | 97.8 | 0.1 | 0.5 | 0.5 | | 1.0 | 0.1 | | | |
| 43 | 97.3 | 0.1 | 0.5 | 0.5 | 0.5 | 1.0 | 0.1 | | | |
| 44 | 87.9 | 10.0 | 0.5 | 0.5 | | 1.0 | 0.1 | | | |
| 45 | 87.4 | 10.0 | 0.5 | 0.5 | 0.5 | 1.0 | 0.1 | | | |
| 46 | 99.0 | 0.5 | | 0.5 | | | | | | |
| 47 | 98.5 | 0.5 | | 0.5 | 0.5 | | | | | |

Table 11

| Sample No. of BP | Sample No. of SG | Electrical Characteristics | | | | |
|---|---|---|---|---|---|---|
| | | C-value (V) | n-value | $V_{10A}/V_{1mA}$ | E(Joule) | Leakage Current (μA) |
| 26 | | 15 | 45 | 1.5 | 96 | 385 |
| 27 | | 15 | 45 | 1.5 | 96 | 78 |
| 28 | | 16 | 46 | 1.5 | 96 | 31 |
| 29 | | 23 | 44 | 1.7 | 78 | 32 |
| 30 | | 28 | 45 | 1.7 | 60 | 30 |
| 31 | | 35 | 45 | 1.8 | 51 | 31 |
| 32 | | 12 | 28 | 1.8 | 108 | 565 |
| 33 | | 15 | 30 | 1.8 | 96 | 97 |
| 34 | | 10 | 34 | 1.7 | 120 | 435 |
| 35 | | 12 | 34 | 1.7 | 108 | 75 |
| 36 | A | 9 | 25 | 2.0 | 120 | 634 |
| 37 | | 10 | 25 | 2.0 | 120 | 98 |
| 38 | | 8 | 23 | 2.0 | 138 | 535 |
| 39 | | 9 | 24 | 2.0 | 138 | 89 |
| 40 | | 7 | 22 | 2.1 | 150 | 516 |
| 41 | | 8 | 24 | 2.1 | 138 | 93 |
| 42 | | 13 | 39 | 1.7 | 108 | 321 |
| 43 | | 13 | 43 | 1.7 | 102 | 83 |
| 44 | | 11 | 46 | 1.7 | 114 | 313 |
| 45 | | 12 | 45 | 1.7 | 114 | 78 |
| 46 | | 13 | 28 | 1.9 | 102 | 513 |
| 47 | | 14 | 28 | 1.9 | 102 | 89 |

Table 12

| Sample No. of BP | Sample No. of SG | Electrical Characteristics | | | | |
|---|---|---|---|---|---|---|
| | | C-value (V) | n-value | $V_{10A}/V_{1mA}$ | E(Joule) | Leakage Current (μA) |
| 27 | | 12 | 45 | 1.5 | 120 | 77 |
| 28 | | 13 | 45 | 1.5 | 120 | 30 |
| 29 | A | 13 | 46 | 1.5 | 120 | 32 |
| 30 | | 14 | 45 | 1.6 | 114 | 28 |
| 31 | | 16 | 46 | 1.6 | 108 | 31 |

Table 13

| Sample No. of BP | Sample No. of SG | Grain size of SP (micron) | Electrical Characteristics | | | | |
|---|---|---|---|---|---|---|---|
| | | | C-value (V) | n-value | $V_{10A}/V_{1mA}$ | E(Joule) | Leakage Current (μA) |
| | | 0.1 to 30 | 13 | 45 | 1.5 | 80 | 55 |

Table 13-continued

| Sample No. of BP | Sample No. of SG | Grain size of SP (micron) | Electrical Characteristics C-value (V) | n-value | $V_{10A}/V_{1mA}$ | E(Joule) | Leakage Current (μA) |
|---|---|---|---|---|---|---|---|
| 28 | A | 30 to 60 | 13 | 45 | 1.6 | 108 | 31 |
| | | more than 60 | 15 | 45 | 2.0 | 65 | 101 |

Table 14

| Sample No. of BP | Sample No. of SG | Sintering temperature (° C.) | Sintering time (hour) | Electrical Characteristics C-value (V) | n-value | $V_{10A}/V_{lmA}$ | E(Joule) | Leakage Current (μA) |
|---|---|---|---|---|---|---|---|---|
| | | 1200° C. | 0.5 | 16 | 45 | 1.6 | 90 | 31 |
| | | | 10 | 15 | 45 | 1.6 | 96 | 32 |
| 28 | A | 1300° C. | 0.5 | 13 | 46 | 1.5 | 120 | 31 |
| | | | 10 | 13 | 46 | 1.5 | 120 | 31 |
| | | 1400° C. | 0.5 | 13 | 45 | 1.5 | 120 | 33 |
| | | | 10 | 13 | 45 | 1.5 | 120 | 32 |

Table 15

| Sample No. of SG | Additives (mole percent) ZnO | BaO | $Co_2O_3$ | $MnO_2$ | NiO |
|---|---|---|---|---|---|
| A | 99.5 | 0.5 | | | |
| N | 98.5 | 0.5 | 0.5 | 0.5 | 1.0 |
| O | 94.3 | 0.5 | 0.1 | 5.0 | 0.1 |
| P | 84.3 | 0.5 | 15.0 | 0.1 | 0.1 |
| Q | 69.3 | 0.5 | 0.1 | 0.1 | 30.0 |

Table 16

| Sample No. of SG | Sample No. of BP | Electrical Characteristics C-value (V) | n-value | $V_{10A/VlmA}$ | E(Joule) | Leakage Current (μA) |
|---|---|---|---|---|---|---|
| A | | 16 | 46 | 1.5 | 96 | 33 |
| N | | 16 | 51 | 1.5 | 102 | 31 |
| O | 2 | 16 | 50 | 1.5 | 102 | 32 |
| P | | 16 | 52 | 1.5 | 101 | 33 |
| Q | | 16 | 50 | 1.5 | 100 | 33 |

Table 17

| Sample No. of SP | Additives (mole percent) ZnO | $Sb_2O_3$ | $Co_2O_3$ | $MnO_2$ | NiO | $Cr_2O_3$ |
|---|---|---|---|---|---|---|
| 1 | 87.5 | 12.5 | | | | |
| 2 | 35 | 5 | 14.4 | 14.4 | 28.2 | 3.0 |
| 3 | 87.4 | 12.2 | 0.1 | 0.1 | 0.1 | 0.1 |
| 4 | 35 | 5 | 60 | | | |
| 5 | 35 | 5 | | 60 | | |
| 6 | 35 | 5 | | | 60 | |
| 7 | 35 | 5 | | | | 60 |
| 8 | 74.35 | 10.8 | 3.29 | 3.29 | 6.58 | 1.69 |

Table 17-continued

| Sample No. of SP | Additives (mole percent) ZnO | $Sb_2O_3$ | $Co_2O_3$ | $MnO_2$ | NiO | $Cr_2O_3$ |
|---|---|---|---|---|---|---|
| 9 | 55.25 | 8.6 | 8.59 | 8.59 | 17.18 | 1.79 |

Table 18

| Sample No. of BP | Sample No. of SG | Sample No. of SP | Electrical Characteristics C-value (V) | n-value | $V_{10A}/V_{lmA}$ | E(Joule) | Leakage Current (μA) |
|---|---|---|---|---|---|---|---|
| | | 1 | 16 | 46 | 1.5 | 96 | 31 |
| | | 2 | 15 | 51 | 1.5 | 113 | 30 |
| | | 3 | 17 | 50 | 1.5 | 100 | 32 |
| | | 4 | 16 | 51 | 1.5 | 105 | 28 |
| 28 | A | 5 | 16 | 50 | 1.5 | 104 | 28 |
| | | 6 | 16 | 50 | 1.5 | 104 | 31 |
| | | 7 | 16 | 50 | 1.5 | 105 | 30 |
| | | 8 | 15 | 53 | 1.5 | 113 | 28 |
| | | 9 | 15 | 53 | 1.5 | 115 | 23 |

What is claimed is:

1. A voltage-dependent resistor having low C-value, high n-value, and high surge energy withstanding capability comprising a sintered body of the bulk type, which body comprises a zinc oxide component as a main component and 0.1 to 25 mole percent, in total, of an additive component for imparting to the sintered body a voltage-dependent property; 10 to 100 weight percent of said zinc oxide component being zinc oxide core grains having a grain size in the range from 100 to 500 microns uniformly dispersed in said sintered body.

2. A voltage-dependent resistor according to claim 1, wherein said zinc oxide component comprises more than 50 weight percent of said zinc oxide core grains.

3. A voltage-dependent resistor according to claim 1, wherein said zinc oxide core grains have a grain size in the range from 100 to 300 microns.

4. A voltage-dependent resistor according to claim 1, wherein said additive component includes 0.1 to 10 mole percent of antimony oxide and 0.1 to 10 mole percent of bismuth oxide on the basis of said sintered body.

5. A voltage-dependent resistor according to claim 4, wherein said antimony oxide is present in said sintered body in the form of a spinel type polycrystalline $Zn_{7/3}Sb_{2/3}O_4$.

6. A voltage-dependent resistor according to claim 4, wherein said additive component further includes a member selected from the group consisting of cobalt oxide, manganese oxide, nickel oxide and chromium oxide, wherein the amount of said member is in the range from 0.8 to 92.3 mole percent on the basis of the sum of said member and said antimony oxide, said antimony oxide being present in said sintered body in the form of a spinel type polycrystalline composed of said antimony oxide, said member and a portion of said zinc oxide component.

7. A voltage-dependent resistor according to claim 1, wherein each of said zinc oxide core grains is a solid solution of zinc oxide and a member selected from the group consisting of 0.1 to 15 mole percent of cobalt oxide, 0.1 to 5.0 mole percent of manganese oxide and 0.1 to 30 mole percent of nickel oxide.

8. A voltage-dependent resistor according to claim 1, wherein said zinc oxide core grains are grains grown from zinc oxide seed grains having a grain size in the range from 20 to 200 microns.

9. A voltage-dependent resistor according to claim 8, wherein said zinc oxide seed grains are grains made by firing a pressed mixture of a zinc oxide powder component and 0.1 to 5 mole percent of a grain growth promoting agent selected from the group consisting of barium oxide, strontium oxide, calcium oxide, sodium oxide, potassium oxide, rubidium oxide, praseodymium oxide, samarium oxide, niobium oxide, tantalum oxide, tungsten oxide, uranium oxide and bismuth oxide.

10. A voltage-dependent resistor according to claim 9, wherein said grain growth promoting agent is a member selected from the group consisting of barium oxide, strontium oxide, calcium oxide, sodium oxide, potassium oxide and rubidium oxide, and said grain growth promoting agent being removed from the fired mixture of said grain growth promoting agent and said zinc oxide powder component.

11. A voltage-dependent resistor according to claim 10, wherein said grain growth promoting agent is barium oxide.

12. A voltage-dependent resistor according to claim 1, wherein said additive component is a member selected from the group consisting of magnesium oxide, beryllium oxide, calcium oxide, strontium oxide, barium oxide, titanium oxide, niobium oxide, tantalum oxide, chromium oxide, tungsten oxide, uranium oxide, manganese oxide, iron oxide, cobalt oxide, nickel oxide, cadmium oxide, boron oxide, aluminum oxide, gallium oxide, indium oxide, silicon oxide, germanium oxide, tin oxide, lead oxide, antimony oxide, bismuth oxide, lanthanum oxide, praseodymium oxide, neodymium oxide and samarium oxide.

13. A method of making a voltage-dependent resistor comprising a sintered body of the bulk type, said method comprising: homogeneously mixing zinc oxide seed grains having a grain size of 20 to 200 microns with a zinc oxide powder and an additive component for imparting to the sintered body a voltage-dependent property, in an amount that the thus made mixture comprises 0.1 to 25 mole percent of said additive component, said zinc oxide component comprising said zinc oxide seed grains and said zinc oxide powder comprising 0.1 to 60 weight percent of said zinc oxide seed grains; compressing the thus made mixture into a compressed body; and sintering the thus made compressed body at a temperature of 1100° to 1400° C., whereby said zinc oxide seed grains take said zinc oxide powder thereinto to grow and have an increased grain size in the range from 50 to 500 microns, a voltage-dependent sintered body being made thereby.

14. A method of making a voltage-dependent resistor according to claim 13, wherein said zinc oxide seed grains are made by firing a mixture of 95 to 99.9 mole percent of a starting zinc oxide powder and 0.1 to 5 mole percent of a grain growth promoting agent selected from the group consisting of barium oxide, strontium oxide, calcium oxide, sodium oxide, potassium oxide, rubidium oxide, praseodymium oxide, samarium oxide, niobium oxide, tantalum oxide, tungsten oxide, uranium oxide and bismuth oxide.

15. A method of making a voltage-dependent resistor according to claim 14, wherein said grain growth promoting agent is one member selected from the group consisting of barium oxide, strontium oxide, calcium oxide, sodium oxide, potassium oxide and rubidium oxide, and said grain growth promoting agent being removed from said fired mixture by washing said fired mixture.

16. A method of making a voltage-dependent resistor according to claim 15, wherein said grain growth promoting agent is barium oxide.

17. A method of making a voltage-dependent resistor according to claim 15, wherein said starting zinc oxide powder to be mixed with said grain growth promoting agent comprises one member selected from the group consisting of 0.1 to 15 mole percent of cobalt oxide, 0.1 to 5.0 mole percent of manganese oxide and 0.1 to 30 mole percent of nickel oxide, to form a solid solution in each of said zinc oxide seed grains.

18. A method of making a voltage-dependent resistor according to claim 14, wherein said mixture of said starting zinc oxide powder and said grain growth promoting agent is fired at a temperature of 1100° to 1600° C.

19. A method of making a voltage-dependent resistor according to claim 18, wherein said mixture of said starting zinc oxide powder and said grain growth promoting agent is fired for 0.5 to 50 hours.

20. A method of making a voltage-dependent resistor according to claim 13, wherein said sintering is carried out for 0.5 to 20 hours.

21. A method of making a voltage-dependent resistor according to claim 13, wherein said zinc oxide seed grains have a grain size of 44 to 150 microns.

22. A method of making a voltage-dependent resistor according to claim 13, wherein the amount of said zinc oxide seed grains in said zinc oxide component is from 2 to 15 weight percent.

23. A method of making a voltage-dependent resistor according to claim 13, wherein said increased grain size of said zinc oxide seed grains is from 100 to 300 microns.

24. A method of making a voltage-dependent resistor according to claim 13, wherein said additive component includes 0.1 to 10 mole percent of antimony oxide and 0.1 to 10 mole percent of bismuth oxide on the basis of said sintered body.

25. A method of making a voltage-dependent resistor according to claim 24, wherein said antimony oxide and a portion of said zinc oxide powder to be added to said zinc oxide seed grains are mixed and heated to form a spinel type polycrystalline $Zn_{7/3}Sb_{2/3}O_4$, prior to the preparation of said mixture of said zinc oxide seed grains, said zinc oxide powder and said antimony oxide.

26. A method of making a voltage-dependent resistor according to claim 25, wherein the temperature for said heating of said mixture of said antimony oxide and said portion of zinc oxide powder to form $Zn_{7/3}Sb_{2/3}O_4$ is from 1300° to 1400° C.

27. A method of making a voltage-dependent resistor according to claim 26, wherein said heating to form $Zn_{7/3}Sb_{2/3}O_4$ is carried out for 0.5 to 10 hours.

28. A method of making a voltage-dependent resistor according to claim 25, wherein said polycrystalline $Zn_{7/3}Sb_{2/3}O_4$ is crushed to granules having a granule size in the range of 0.1 to 60 microns, prior to the preparation of said mixture of said zinc oxide seed grains, said zinc oxide powder and said antimony.

29. A method of making a voltage-dependent resistor according to claim 24, wherein said additive component includes 0.1 to 10 mole percent, in total, of antimony oxide and one member selected from the group consisting of cobalt oxide, manganese oxide, nickel oxide and chromium oxide in an amount that the amount of said antimony oxide is in the range from 99.2 to 7.7 mole percent on the basis of the sum of said antimony oxide and said one member.

30. A method of making a voltage-dependent resistor according to claim 29, wherein said antimony oxide, said one member and a portion of said zinc oxide powder to be added to said zinc oxide seed grains are mixed and heated to a sintered powder mainly of a spinel type polycrystalline material, prior to the preparation of said mixture of said zinc oxide seed grains, said zinc oxide powder, said antimony and said one member.

31. A method of making a voltage-dependent resistor according to claim 30, wherein the temperature for said heating of said mixture of said antimony oxide, said one member and said portion of said zinc oxide powder to form said spinel type polycrystalline is from 1100° to 1400° C.

32. A method of making a voltage-dependent resistor according to claim 31, wherein said heating to form said spinel type polycrystalline material is carried out for 0.5 to 20 hours.

33. A method of making a voltage-dependent resistor according to claim 30, wherein said spinel type polycrystalline material is crushed to granules having a granule size in the range of 0.1 to 60 microns, prior to the preparation of said mixture of said zinc oxide seed grains, said zinc oxide powder, said antimony oxide and said one member.

34. A method of making a voltage-dependent resistor according to claim 13, wherein each of said zinc oxide seed grains is a solid solution of zinc oxide and a member selected from the group consisting of 0.1 to 15 mole percent of cobalt oxide, 0.1 to 5.0 mole percent of manganese oxide and 0.1 to 30 mole percent of nickel oxide.

35. A method of making a voltage-dependent resistor according to claim 13, wherein said additive component is a member selected from the group consisting of magnesium oxide, beryllium oxide, calcium oxide, strontium oxide, barium oxide, titanium oxide, niobium oxide, tantalum oxide, chromium oxide, tungsten oxide, uranium oxide, manganese oxide, iron oxide, cobalt oxide, nickel oxide, cadmium oxide, boron oxide, aluminum oxide, gallium oxide, indium oxide, silicon oxide, germanium oxide, tin oxide, lead oxide, antimony oxide, bismuth oxide, lanthanum oxide, praseodymium oxide, neodymium oxide and samarium oxide.

* * * * *